United States Patent [19]

Ikeda et al.

[11] 4,449,025

[45] May 15, 1984

[54] DOOR SEAL CONSTRUCTION FOR HIGH FREQUENCY HEATING APPLIANCE

[75] Inventors: Nobuo Ikeda; Hirofumi Yoshimura, both of Nara, Japan

[73] Assignee: Matsushita Electric Industrial Co., Ltd., Osaka, Japan

[21] Appl. No.: 307,361

[22] Filed: Sep. 30, 1981

[30] Foreign Application Priority Data

Oct. 3, 1980 [JP] Japan ..... 55-138942

[51] Int. Cl.[3] ..... H05B 6/76

[52] U.S. Cl. ..... 219/10.55 D; 174/35 GC

[58] Field of Search ..... 219/10.55 D, 10.55 R; 174/35 GC, 35 R, 35 SM

[56] References Cited

U.S. PATENT DOCUMENTS

| | | | |
|---|---|---|---|
| 3,584,177 | 6/1971 | Bucksbaum | 219/10.55 D |
| 3,629,537 | 12/1971 | Haagensen | 219/10.55 D |
| 3,668,357 | 6/1972 | Kobayashi | 219/10.55 D |
| 3,678,238 | 7/1972 | Yasuoka et al. | 219/10.55 D |
| 4,081,647 | 3/1978 | Torrey | 219/10.55 D |
| 4,347,420 | 8/1982 | Ikeda et al. | 219/10.55 D |
| 4,358,653 | 11/1982 | Weiss | 219/10.55 D X |

*Primary Examiner*—B. A. Reynolds
*Assistant Examiner*—Philip H. Leung
*Attorney, Agent, or Firm*—Wenderoth, Lind & Ponack

[57] ABSTRACT

A microwave leakage-preventive device for use with a high frequency heating appliance for dielectric heating of an object by high frequency energy has a choke attenuator installed in a door for attenuation of microwaves, the choke attenuator being of the type adapted to enter an oven cavity when the door is closed. A portion of the choke attenuator is received in a recess formed within the door body, so that the choke attenuator entering the oven cavity is made smaller by an amount corresponding to the dimension thereof received in the door body. The width of the recess formed within the door body is made larger than the width of the choke attenuator entering the oven cavity, thereby providing a small-thickness door which is superior in microwave leakage prevention.

2 Claims, 4 Drawing Figures

DOOR SEAL CONSTRUCTION FOR HIGH FREQUENCY HEATING APPLIANCE

BACKGROUND OF THE INVENTION

The present invention relates to a construction for prevention of leakage of microwaves from the periphery of the door of a high frequency heating appliance and more particularly the invention is intended to achieve improved microwave leakage-preventive performance as well as cost reduction and to provide a light-weight door by minimizing the thickness of the door of the type in which a choke attenuator enters the oven cavity.

Conventionally, in high frequency heating appliances of the type additionally using electric heaters and having a pyrolytic self-cleaning function, it has been necessary during the cleaning function to raise the oven cavity temperature to about 500° C., making it necessary to increase the thickness of the door, as compared with ordinary ovens, to improve the heat insulating performance of the door.

As for microwave seal-in constructions for this kind of oven, the one shown in FIG. 1, which is of the type in which a choke attenuator enters an oven cavity, is in wide use. With this construction, however, since a choke groove which is as long as ¼ of the operating microwave wavelength, or about 30 mm, projects into the oven cavity, the effective size of the oven cavity is correspondingly decreased. Moreover, since the thickness of the door becomes quite large, the door itself is quite heavy and hence the door and the door support construction are expensive. A reduction in the size of the choke attenuator would reduce the door thickness, but with this measure alone the microwave seal-in performance would be degraded.

SUMMARY OF THE INVENTION

Accordingly, an object of the invention is to provide a small-thickness, low cost, door seal construction which is superior in microwave leakage-prevention.

The arrangement according to the invention comprises a heating chamber, a high frequency oscillator for feeding high frequency energy into the heating chamber, a door for opening and closing the front opening in the heating chamber, and a choke attenuator installed on the door and adapted to enter the oven cavity, wherein a portion of a choke groove for the choke attenuator is recessed within the door body, so that the size of the choke projecting into the oven cavity is correspondingly reduced, the width of the recess within the door body being larger than the width of the choke groove entering the oven cavity.

Further, the invention provides a small-thickness type door which is superior in microwave leakage-preventive performance, wherein the width of said recess is larger than (the width of the choke groove entering the oven cavity)+(the clearance between the oven wall and the choke).

DESCRIPTION OF THE PREFERRED EMBODIMENT

Figure 1:
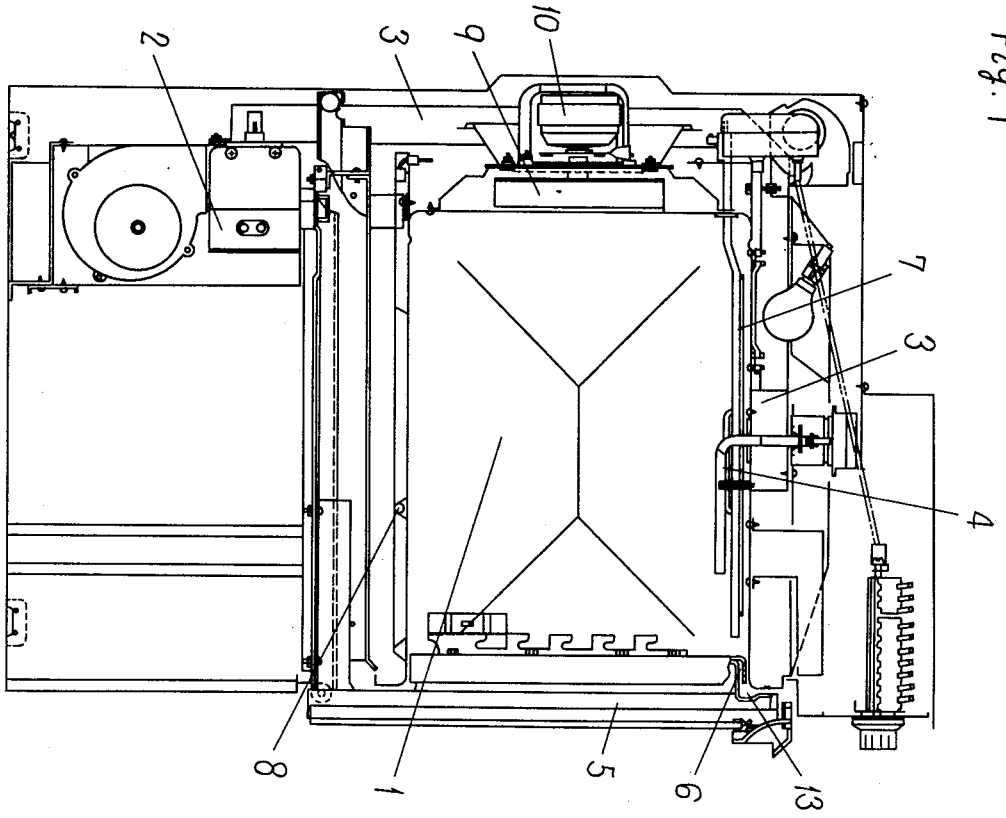
FIG. 1 is a sectional elevation of a high frequency heating appliance of the type also having electric resistance heaters, with a door seal construction according to the invention included therein.

Referring to FIG. 1, the numeral 1 denotes an oven cavity, and microwaves from a magnetron 2, which is a high frequency oscillator, are guided by a waveguide 3 and radiated into the oven cavity 1 by a rotary antenna 4 installed in the upper middle region of the oven cavity. The front inlet of the oven cavity 1 is opened and closed by a door 5, which is provided with a choke attenuator 6 arranged so that it enters the oven cavity when the door is closed. The numerals 7 and 8 denote electric resistance heaters; 9 denotes a fan for circulating hot air; and 10 denotes a motor for driving said fan.

Figure 2:
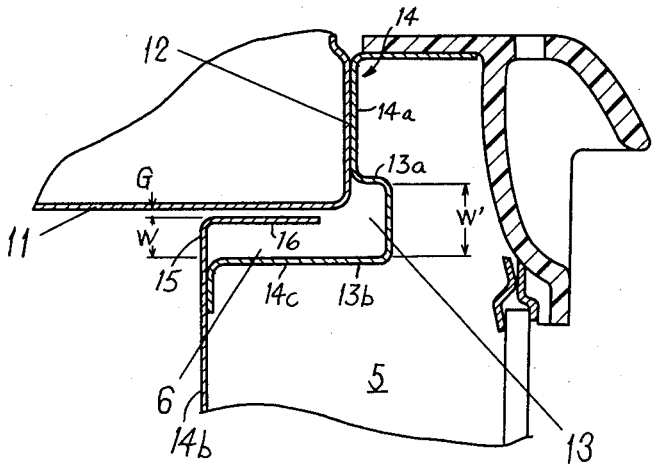
FIG. 2 is an enlarged fragmentary view, in section, showing the principal portion of the door seal construction.

FIG. 2 is an enlarged fragmentary view, in section, showing the principal portion of the embodiment of the invention, wherein 11 denotes the inner wall of the oven cavity, and 12 denotes the front wall of the oven cavity. The door 5 has an inwardly facing door surface 14 facing toward the heating cavity 1 and which has an outer peripheral part **14*a* engagable with the front wall 12 when the door is closed and a central inner part 14*b* which is positioned within the cavity 1 when the door is closed. The choke attenuator 6 is positioned around the periphery of the door between the outer peripheral part 14*a* and the inner part 14*b* and has an inwardly extending wall part 14*c* extending between the outer peripheral part 14*a* and the inner part 14*b*, and end wall 15 extending radially outwardly from the inner part 14*b*, and an outer wall 16 extending parallel to the inwardly extending wall part 14*c* and extending outwardly from the radially outer end of the end wall 15 and terminating short of the outer peripheral part 14*a*. It is spaced slightly from the inner wall 11 of the cavity. The outer peripheral part 14*a* has a recess 13 at the radially inner end thereof and which opens toward the cavity, the recess having a radially inner side wall 13*b* which is an extension of the inwardly extending wall part 14*c* of the choke attenuator, and a radially outer side wall 13*a* spaced outwardly of the outer wall 16. The recess 13 thus forms the outer end of the groove within the choke attenuator 6**.

Figure 3:
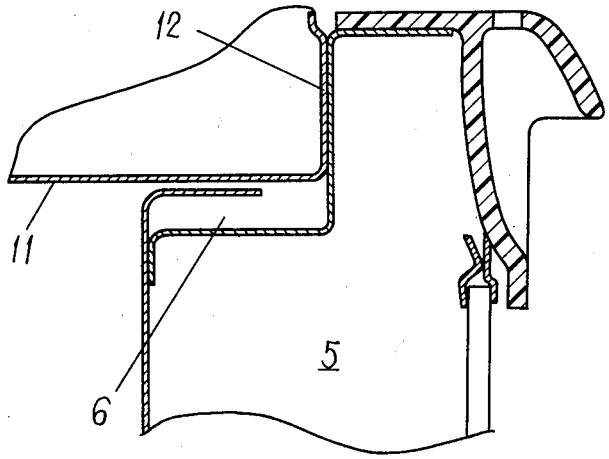
Fig. 3 PRIOR ART
FIG. 3 is an enlarged fragmentary view, in section, showing a conventional door seal construction.

The choke attenuator 6 installed in the door 5, in the conventional example shown in FIG. 3, will completely enter the oven cavity when the door is closed, but in the illustrated embodiment of the invention, since a portion of choke groove is defined by a recess 13 formed within the door body, the corresponding portion of the choke attenuator does not enter the oven cavity, so that the thickness of the door can be reduced by an amount corresponding to the depth of the recess 13.

Figure 4:
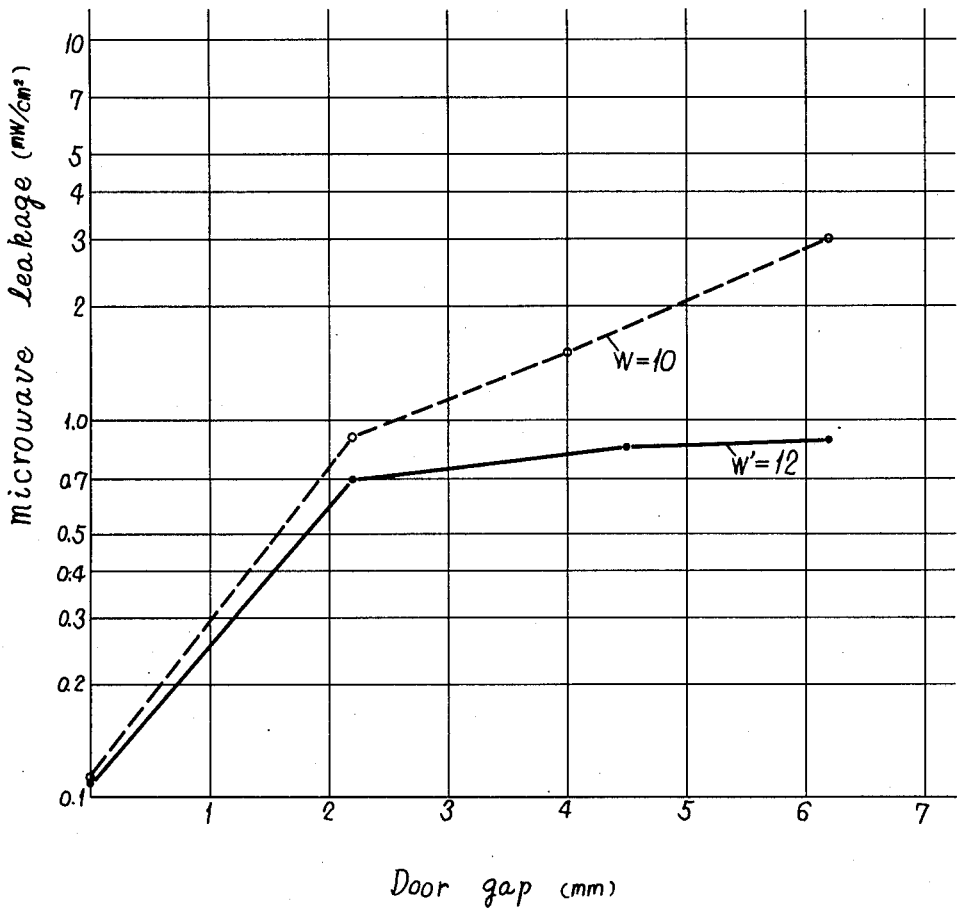
FIG. 4 is a graph showing experimental results of a comparison of the doors of FIGS. 2 and 3.

However, a simple reduction in the thickness of the door would increase the amount of leakage of microwaves when the door is gradually opened. In this connection, it has been found that the seal performance for prevention of leakage of microwaves can be improved even with a door of reduced thickness if the relation between the width W′ of the recess 13, the width W of the choke groove and the clearance G between the choke and the inner wall surface of the oven is set such that $W' > W + G$. As seen in the graph of FIG. 4 showing experimental results, when comparative experiments were performed with respect to W'=10 mm and W'=12 mm under the conditions W=8 mm and G=2.5 mm, with a clearance of about 4.5–6 mm kept between the door and the front wall surface of the oven, it has been ascertained that the microwave leakage for W'=12 was about ½–⅓ of the value for W'=10.

What is claimed is:

1. A microwave heating apparatus, comprising:

a heating cavity having a front opening thereinto, an inner wall extending inwardly into said cavity from said front opening and a front wall extending radially away from said front opening parallel to the plane of said front opening;

means for generating microwave energy and for guiding said energy into said heating cavity;

a door mounted on said apparatus for opening and closing said front opening, said door having an inwardly facing door surface facing toward said heating cavity which has an outer peripheral part engagable with said front wall when said door is closed and having a central inner part which is positioned within said cavity when said door is closed;

a choke attenuator around the periphery of said door between said outer peripheral part of said inwardly facing door surface and said inner part of said inwardly facing door surface and being constituted only by an inwardly extending wall part extending between said outer peripheral part and said inner part of said inwardly facing door surface, an end wall extending radially outwardly from said inner part of said inwardly facing door surface, and an outer wall extending parallel to said inwardly extending wall part and extending outwardly from the radially outer end of said end wall and terminating short of said outer peripheral part of said inwardly facing door surface and spaced slightly radially inwardly of said inner wall when said door is closed, the space within said choke attenuator being unobstructed, said outer peripheral part of said inwardly facing door surface having a recess at the radially inner end thereof and having an opening facing toward said cavity, the recess having a radially inner side wall which is an extension of said inwardly extending wall part of said choke attenuator, and a radially outer side wall spaced outwardly of said outer wall of said choke attenuator, said opening extending between said radially inner side wall and said radially outer side wall and being unobstructed.

2. A high frequency heating appliance as set forth in claim 1, wherein the width of said recess parallel to the plane of said front opening is greater than the sum of the width of the choke attenuator in the same direction and the space between the inner wall surface of the oven cavity and the outer wall of said choke attenuator.

* * * * *